United States Patent [19]

Faure et al.

[11] Patent Number: 5,073,207

[45] Date of Patent: Dec. 17, 1991

[54] PROCESS FOR OBTAINING MAGNESIUM ALLOYS BY SPRAY DEPOSITION

[75] Inventors: Jean-François Faure, Voiron; Gilles Nussbaum; Gilles Regazzoni, both of Grenoble, all of France

[73] Assignee: Pechiney Recherche, Courbevoie, France

[21] Appl. No.: 571,224

[22] Filed: Aug. 23, 1990

[30] Foreign Application Priority Data

Aug. 24, 1989 [FR] France ..... 89 11356

[51] Int. Cl.[5] ..... C22C 23/02; C22C 23/04

[52] U.S. Cl. ..... 148/2; 420/407

[58] Field of Search ..... 148/2; 420/407

[56] References Cited

FOREIGN PATENT DOCUMENTS 8908154 9/1989 World Int. Prop. O. .

*Primary Examiner*—Upendra Roy

*Attorney, Agent, or Firm*—Dennison, Meserole, Pollack & Scheiner

[57] ABSTRACT

Process for economically obtaining a magnesium alloy having improved mechanical characteristics and in particular a breaking strength of at least 290 MPa and an elongation at break of at least 5%, by spraying and deposition in solid form to provide an ingot with the following weight composition: Al 2–9%; Zn 0–4%; Mn 0–1%; Ca 0.5–5%; RE 0–4% (rare earths); and, with the main impurities, the remainder being magnesium. The ingot undergoes a consolidation treatment by thermal deformation at between 200° and 250° C. The alloys obtained by the process are constituted by a homogeneous magnesium matrix with the grain size between 3 and 25 μm and particles of intermetallic compounds.

17 Claims, No Drawings

PROCESS FOR OBTAINING MAGNESIUM ALLOYS BY SPRAY DEPOSITION

TECHNICAL FIELD

The invention relates to an economic process for obtaining a magnesium alloy having improved mechanical characteristics, namely a breaking strength better than 290 MPa, elongation at break of generally at least 5% and improved corrosion resistance properties, as well as to the alloy obtained by this process.

STATE OF THE ART

The aim has been to improve the mechanical characteristics of commercially available, magnesium-based alloys (e.g. of type AZ91 according to the ASTM standard, or type GA9 according to French standard NF A02-004) obtained by conventional casting, drawing and possibly annealing. In order to improve the mechanical characteristics, it is known to use a fast solidification method consisting of melting the alloy, very rapidly cooling it accompanied by casting, e.g. on a vigorously cooled drum and then consolidating it, e.g. by drawing. This type of procedure is difficult to perform, particularly on a large scale and leads to expensive alloys.

It is also known to obtain good mechanical characteristics by using alloys of type ZK60 (ASTM standard) containing zirconium, obtained by conventional casting, drawing and optionally annealing, but the use thereof is also onerous.

Taking account of the above, the Applicant has sought to utilize simpler means or processes, which are consequently more economic and in this way to significantly improve the properties, more especially the mechanical characteristics and corrosion resistance, of magnesium-based alloys obtained by conventional casting.

OBJECT OF THE INVENTION

Taking account of what has been stated hereinbefore, the Applicant has attempted to develop an economic process for obtaining a magnesium-based alloy having improved mechanical characteristics and in particular a breaking strength better than 290 MPa and more particularly at least 300 MPa, whilst still having an elongation at break of at least 5% and very good corrosion preventing characteristics.

This process is characterized in that by spraying and deposition in solid form (generally known as spray deposition) an ingot is formed having the following composition by weight:

Al: 2–9%
Zn: 0–4%
Mn: 0–1%
Ca: 0.5–5%
RE: 0–4% (rare earths)

with the following main impurity contents:

Si<0.6%
Cu<0.2%
Fe<0.1%
Ni<0.01% the remainder being magnesium and in that said ingot undergoes a consolidation treatment by thermal deformation at between 200° and 350° C.

Another object of the invention is the alloy obtained by the inventive process and which is characterized by a homogeneous magnesium matrix, whose grain size is between 3 and 25 μm having particles of intermetallic compounds, preferably precipitated at the grain boundaries, of type $Mg_{17}Al_{12}$, $Al_2Ca$, Mg-RE, Al-RE with dimensions smaller than 5 μm. This structure remains unchanged after maintaining for 24 hours at 350° C.

DESCRIPTION OF THE INVENTION

According to the invention, the alloy still contains calcium and aluminium. Each of these two elements is relatively soluble in magnesium in the solid state. However, their simultaneous presence in the alloy generally leads to the precipitation of the intermetallic compound $Al_2Ca$ at the grain boundaries and in the matrix, said precipitate being responsible for the improvement to the aforementioned characteristics.

It has the following preferred composition:

Al: 5–9%
Zn: 0–3%
Mn: 0–1%
Ca: 0.5–5%
RE: 0–4% which is generally favourable for preventing corrosion and is of interest, particularly when the alloy contains no rare earths.

However, it is of particular interest to use the following composition:

Al: 5–9%
Zn: 0–3%
Mn: 0–0.6%
Ca: 1–5%
ER: 0–3% which generally makes it possible to improve the mechanical characteristics as a result of the presence of a relatively large amount of Ca in order to increase the quantity of precipitated intermetallic compound $Al_2Ca$ (hardening agent).

RE is understood to mean rare earths, particularly Nd, Ce, La, Pr, misch metal (MM), as well as Y. It is also possible to use a mixture of these elements.

The process consists of spraying the melted alloy with the aid of a neutral gas, such as Ar, He or $N_2$, at high pressure, in the form of fine liquid droplets, which are then directed onto and agglomerated on a cooled substrate, generally formed by the solid alloy, or by any other metal, e.g. stainless steel, so as to form a solid, coherent deposit, but which still has a limited closed porosity. The ingot obtained can be in the form of billets, tubes, plates, etc., whose geometry is controlled. A procedure of this type is generally known as spray deposition.

Although this process utilizes the spraying of a jet of alloy melted by a neutral gas, it differs both from the roller or drum tempering or hardening processes and on the other hand from the conventional atomization processes. It differs from roller hardening processes by a much higher cooling speed, which is generally between 10K and $10^3$K/second for the process used in the present invention and between $10^4$K and $10^7$K/second for the processes involving hardening on a roller and atomization.

It also differs from conventional atomization processes by the fact that the metal droplets, when they reach the cooled substrate or billet which is forming, are only partly solidified. On the surface of the billet liquid metal remains and with it agglomerate the semi-liquid droplets. Complete solidification only occurs subsequently.

Moreover, in the process according to the invention, the solidification speed is faster than in the conventional production processes (e.g. moulding, conventional casting, etc.), where it is well below 10K/second.

Thus, according to the invention, a solid product with a fine grain equiaxial structure is obtained.

The thus obtained ingot is transformed by thermal deformation at between 200° and 350° C. and preferably by drawing and/or forging, but also by HIP (hot isostatic pressing). It is remarkable that such alloys can be transformed at such high temperature, reaching 350° C., whilst retaining excellent mechanical characteristics. Such a thermal stability has numerous advantages, particularly the possibility of using a high drawing speed, high drawing ratios, etc. whilst retaining the good mechanical characteristics resulting from the invention.

Optionally and with a view to improving their properties, the consolidated ingots can undergo heat treatments, either by dissolving, followed by temper hardening (treatment T6), or directly by tempering (treatment T5). Typically the dissolving of the alloys takes place as a result of a heat treatment for at least 8 h at 400° C. It is followed by hardening in water or oil and then tempering e.g. for 16 h at 200° C. to obtain a maximum hardness.

The alloys obtained according to the invention have a homogeneous structure, preferably with a grain size between 3 and 25 μm and having particles of intermetallic compounds preferably precipitated at the grain boundaries.

It should in particular be noted that Ca generally precipitates in the form of the intermetallic compound $Al_2Ca$, i.e. a compound between two addition elements and that for the lowest Ca contents, it is only present in very small amounts in solid solution in the Mg matrix and is not observed in the form Mg Ca, which is the compound normally expected in a Mg/Ca system.

As stated, $Mg_{17}Al_{12}$ Mg-RE and/or Al-RE is present, as a function of the nature and content of the rare earth or earths added.

With the process according to the invention, magnesium-based alloys are obtained, which have excellent mechanical characteristics significantly better than those obtained with the prior art alloys using conventional casting and in particular the breaking strength is better than 330 MPa, the addition elements also bringing about a better thermal stability and an improvement to the corrosion characteristics. In particular, the weight loss noted with the alloys according to the invention following hardening in a 5% by weight NaCl aqueous solution, expressed in mcd (milligram/cm²/day) does not exceed 0.8 mcd, whereas for a conventional drawing alloy AZ91 it can reach 2 mcd. Generally the corrosion observed is perfectly homogeneous and uniform and thus avoids the presence of pitting or preferred corrosion zones, which can form the basis for preferred breaking zones.

In addition, the process according to the invention is more economic, inter alia due to a higher and more reliable productivity than in the processes involving hardening on a roller or atomization, because there is no need to handle divided products.

Finally, the products obtained contain neither oxides, nor hydrates liable to cause pores or inclusions. Therefore the metallurgical health is better, which leads to an improvement in the tolerance to damage (fatigue, toughness, ductility) compared with the prior art alloys, or those obtained by fast solidification and/or powder metallurgy.

EXAMPLES

The following examples illustrate the mechanical characteristics and corrosion resistance properties in a NaCl medium obtained according to the invention.

EXAMPLE 1

Use is made of different alloy formulations which, after bringing into liquid form, have been sprayed with the aid of argon or nitrogen and deposited on a stainless steel collecting substrate at a distance of 600 mm in order to form diameter 150 mm billets. The distance of 600 mm is kept constant during deposition and the collector performs a rotary movement about its axis. The atomizer oscillates with respect to the rotation axis of the collector. The cooling speed is approximately $10^2$K/sec. The gas flow rate is approximately 3.1 $Nm^3$/kg and the liquid flow rate approximately 3 to 4 kg/min, being identical between the individual tests.

The billets obtained are then consolidated by drawing at 300° C. with a drawing ratio of 20 and a ram advance speed of 1 mm/sec.

Table 1 gives the results obtained: TYS (0.2) represents the yield point measured at 0.2% tensile elongation and expressed in MPa.

UTS represents the breaking load, expressed in MPa.

e represents the elongation at break, expressed in %.

Corrosion: weight loss expressed in mg/cm²/day (mcd), observed following the immersion of the sample in a 5% NaCl solution for 3 days-corrosion appearance.

TABLE 1

| | Test No. | | | | | | |
|---|---|---|---|---|---|---|---|
| | | | | | | prior art | |
| | 1 | 2 | 3 | 4 | 5 | 6 (AZ91) | 7 (AZ91) |
| Weight % composition of alloy (1) | | | | | | | |
| Al | 5 | 9 | 8.5 | 7 | 7 | 8.5 | 8.5 |
| Zn | 3 | 0 | 0.6 | 1.5 | 1.5 | 0.6 | 0.6 |
| Mn | 0 | 0 | 0.2 | 0 | 1 | 0.2 | 0.2 |
| Ca | 2.5 | 2.5 | 2 | 4.5 | 4.5 | 0 | 0 |
| RE (2) | 2.0 | 2.0 | 0 | 1.0 | 0 | 0 | 0 |
| Drawing temperature °C. | 300 | 300 | 300 | 300 | 300 | 200 | 210 |
| TYS (0.2) MPa | 346 | 381 | 305 | 435 | 381 | 226 | 307 |
| UTS MPa | 382 | 423 | 365 | 480 | 422 | 313 | 389 |
| e % | 22.3 | 18.0 | 9.5 | 5 | 8.8 | 15.6 | 16.5 |
| Corrosion: weight loss mg/cm²/d | 0.25 | 0.80 | 0.08 | 0.25 | 0.4 | 0.5 | 0.5 |
| corrosion type | uni- | fili- | uni- | uni- | uni- | fili- | fili- |

TABLE 1-continued

| | Test No. | | | | | | |
|---|---|---|---|---|---|---|---|
| | | | | | | prior art | |
| | 1 | 2 | 3 | 4 | 5 | 6 (AZ91) | 7 (AZ91) |
| | form | form | form | form | form | form | form |

(1) The remainder being magnesium
(2) The rare earth used in these examples is Nd In the table tests 1 to 5 illustrate the invention, whereas tests 6 and 7 give results falling outside the invention (prior art).

Test 6 relates to a type AZ 91 alloy obtained by conventional casting and drawing, whereas test 7 relates to the same type of alloy obtained by spray deposition and drawing. It should be noted that these alloys are close to AZ 80, which is the standard working alloy (like alloy ZK60 containing Zr), considered to give the best mechanical characteristics after drawing, according to the prior art.

It can be seen that the alloys according to the invention give significantly better mechanical characteristics than those of the prior art alloys, although drawing took place at a temperature of 300° C., which is less favourale than the 200° C. of tests 6 and 7 for obtaining good mechanical characteristics. It should also be noted that according to the invention, it is simultaneously possible to reduce the weight loss due to corrosion to a factor of 5 or 6, whilst obtaining a uniform corrosion (test 3) and that the use of rare earths makes it possible to increase the mechanical characteristics with a uniform corrosion (tests 1 and 4).

By comparison, it can be seen that the conventional alloy (test 6) and the commercial alloy obtained by spray deposition (test 7) have mechanical characteristics and/or a corrosion resistance (weight loss and/or appearance) inferior to those of all the alloys according to the invention.

EXAMPLE 2

On four alloys the breaking load UTS, the toughness by the factor $K_{1C}$ (so-called short bar test), the endurance limit, i.e. the stress to be applied in order to break a sample after $10^7$ rotary bending cycles, accompanied by the calculation of the endurance ratio, the ratio of the endurance limit to the breaking load.

The first two alloys are produced according to the invention, namely alloys 3 and 4 in table 1. The third alloy is a conventional AZ80 alloy.

The fourth has the same composition of alloy 3, but was rapidly solidified by hardening on a roller and then consolidated by drawing.

The results of the measurements appear in the following table 2:

TABLE 2

| | UTS (MPa) | Toughness (MPa $\sqrt{m}$) | Endurance limit (MPa) | Endurance ratio |
|---|---|---|---|---|
| Alloy 3* (AZ91 + 2% Ca) | 365 | 35 | 170 | 0.47 |
| Alloy 4* | 480 | 30 | 215 | 0.45 |
| Conventional AZ80 | 380 | 29 | 160 | 0.42 |
| AZ91 + 2% Ca, rapid solidification | 452 | 19 | 175 | 0.39 |

*According to the invention.

It is found that the alloys according to the invention have:

a breaking load equal to or better than that of the conventional alloys, but inferior to or equal to that of alloys obtained by fast solidification;

a toughness better than that of the alloys obtained by the two other processes used;

a generally superior endurance limit, or at least of the same order of magnitude as that of the conventional alloys or those solidified rapidly;

a significantly superior endurance ratio to that of the conventional alloys or those solidified rapidly.

We claim:

1. Process for obtaining a magnesium alloy having improved mechanical characteristics, including a breaking load of at least 290 MPa and an elongation at break of at least 5%, comprising spray depositing to form an ingot having a composition, by weight:

Al: 2–9%;
Zn: 0–4%;
Mn: 0–1%,
Ca: 0.5–5%, and
rare earths: 0–4%;

with the following main impurity contents:

Si<0.6%,
Cu<0.2%,
Fe<0.1%,
Ni<0.01%:

the remainder being magnesium, the cooling rate of said spray depositing being between 10 and $10^{3°}$ K./sec, and consolidating said ingot by thermal deformation at between 200° and 350° C.

2. Process according to claim 1, wherein the weight composition is:

Al: 5–9%,
Zn: 0–3%,
Mn: 0–1%,
Ca: 0.5–5%, and
rare earths: 0–4%;

and the remainder said impurities and magnesium.

3. Process according to claim 1, wherein said alloy comprises:

Al: 5–9%,
Zn: 0–3%,
Mn: 0–0.6%,
Ca: 0.5–5%, and
rare earths 0–3%;

the remainder being said impurities and magnesium.

4. Process according to any one of the claims 1 to 3, wherein the rare earths are selected from the group consisting of Y, Nd, Ce, La, Pr, misch metal (MM) and mixtures thereof.

5. Process according to any one of the claims 1 to 3, wherein said spray depositing is carried out by an inert gas.

6. Process according to any one of the claims 1 to 3, wherein the consolidating comprises drawing, forging or a combination thereof.

7. Process according to any one of the claims 1 to 3, further comprising thermally treating the consolidated ingot for dissolving the addition elements, followed by temper hardening or optionally temper hardening only, to further improve the mechanical characteristics.

8. Alloy obtained by any one of the claims 1 to 3, comprising a homogeneous magnesium matrix with grain size between 3 and 25 μm and particles of one or more intermetallic compounds selected from the group consisting of $Mg_{17}Al_{12}$, $Al_2Ca$, Mg-rare earth and Al-rare earth, with dimensions below 5 μm.

9. Alloy obtained by any one of claims 1 to 3, comprising a homogeneous magnesium matrix with grain size between 5 and 15 μm and particles of one or more intermetallic compounds selected from the group consisting of $Mg_{17}Al_{12}$, $Al_2Ca$, Mg-rare earth and Al-rare earth, with dimensions below 5 μm precipitated at the grain boundaries.

10. Process according to claim 4 wherein said spray depositing is carried out by an inert gas.

11. Process according to claim 4 further comprising thermally treating the consolidated ingot for dissolving the addition elements, followed by temper hardening, or optionally temper hardening only, to further improve the mechanical characteristics.

12. Alloy obtained by claim 4 comprising a homogeneous magnesium matrix with grain size between 5 and 15 μm and particles of one or more intermetallic compounds selected from the group consisting of $Mg_{17}Al_{12}$, $Al_2Ca$, Mg-rare earth and Al-rare earth, with dimensions below 5 μm precipitated at the grain boundaries.

13. Process according to claim 5 further comprising thermally treating the consolidated ingot for dissolving the addition elements, followed by temper hardening, or optionally temper hardening only, to further improve the mechanical characteristics.

14. A process according to claim 5, wherein the inert gas is Ar, He or $N_2$.

15. Process according to claim 6 further comprising thermally treating the consolidated ingot for dissolving the addition elements, followed by temper hardening, or optionally temper hardening only, to further improve the mechanical characteristics.

16. Alloy obtained by claim 6 comprising a homogeneous magnesium matrix with grain size between 3 and 25 μm and particles of one or more intermetallic compounds selected from the group consisting of $Mg_{17}Al_{12}$, $Al_2Ca$, Mg-rare earth and Al-rare earth, with dimensions below 5 μm.

17. A process according to claim 10, wherein the inert gas is Ar, He or $N_2$.

* * * * *